US007805887B2

(12) United States Patent
Kita

(10) Patent No.: US 7,805,887 B2
(45) Date of Patent: Oct. 5, 2010

(54) OPEN/CLOSE MEMBER DRIVING APPARATUS

(75) Inventor: Shinichiro Kita, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 604 days.

(21) Appl. No.: 11/878,376

(22) Filed: Jul. 24, 2007

(65) Prior Publication Data

US 2008/0060272 A1 Mar. 13, 2008

(30) Foreign Application Priority Data

Sep. 8, 2006 (JP) ..... 2006-243822

(51) Int. Cl.
*E05F 11/00* (2006.01)

(52) U.S. Cl. ..... 49/360; 192/84.961; 296/155

(58) Field of Classification Search ..... 49/360, 49/348, 349; 192/84.961; 296/155
See application file for complete search history.

(56) References Cited

U.S. PATENT DOCUMENTS 4,640,050 A * 2/1987 Yamagishi et al. ..... 49/280
5,138,795 A * 8/1992 Compeau et al. ..... 49/138
5,875,588 A * 3/1999 Torii et al. ..... 49/349
6,112,583 A * 9/2000 Yamamura ..... 73/117.01
6,183,040 B1 * 2/2001 Imaizumi et al. ..... 296/155
6,397,523 B1 * 6/2002 Fukumoto et al. ..... 49/360
6,408,573 B1 * 6/2002 Fukumoto et al. ..... 49/360
6,964,449 B2 * 11/2005 Takeda et al. ..... 296/146.4
7,275,629 B2 * 10/2007 Fukumoto et al. ..... 192/84.961
7,287,804 B2 * 10/2007 Yamagishi et al. ..... 296/155
7,325,361 B2 * 2/2008 Rogers et al. ..... 49/360
7,422,094 B2 * 9/2008 Yokomori ..... 192/84.7
7,434,354 B2 * 10/2008 Yokomori ..... 49/360
7,568,310 B2 * 8/2009 Sato et al. ..... 49/360
7,584,572 B2 * 9/2009 Yokomori et al. ..... 49/360
7,644,540 B2 * 1/2010 Ichinose ..... 49/360
2005/0039405 A1 * 2/2005 Yokomori ..... 49/360
2005/0055883 A1 * 3/2005 Sato et al. ..... 49/360
2005/0183924 A1 * 8/2005 Fukumoto et al. ..... 192/84.961
2006/0112643 A1 * 6/2006 Yokomori et al. ..... 49/360
2006/0156630 A1 * 7/2006 Yokomori et al. ..... 49/360
2009/0173011 A1 * 7/2009 Kita et al. ..... 49/349

FOREIGN PATENT DOCUMENTS

JP 2005-232918 9/2005

* cited by examiner

*Primary Examiner*—Jerry Redman
(74) *Attorney, Agent, or Firm*—Foley & Lardner LLP

(57) ABSTRACT

A clutch mechanism and a worm wheel are disposed in such a manner as to be aligned or superposed on each other via a base plate held therebetween. A circular swollen portion is formed on the base plate in such a manner as to project from one side to another side of the base plate. The swollen portion is disposed in such a manner as to face the worm wheel, and a side of a field core of a clutch mechanism is accommodated within a dish-shaped recess formed on a rear side of the swollen portion.

8 Claims, 3 Drawing Sheets

OPEN/CLOSE MEMBER DRIVING APPARATUS

This application claims priority from Japanese Patent Application No. 2006-243822, filed on Sep. 8, 2007, the entire subject matter of which is incorporated herein by reference.

BACKGROUND OF THE INVENTION

1. Field of the Invention

The present invention relates to an open/close member driving apparatus for opening and closing an open/close member which is supported on a vehicle body or the like in such a manner as to be opened and closed.

2. Description of the Related Art

Heretofore, an open/close member driving apparatus includes an output drum and a clutch mechanism. The output drum is pivotally supported on a base member via a shaft in such a manner as to rotate freely and round an outer circumferential surface of which a cable which transmits a driving force to an open/close member such as a sliding door is wound. The clutch mechanism, into which a driving force from a motor is inputted via a speed reduction mechanism, is switched between an engaged state in which the driving force is transmitted to the output drum and a disengaged state in which the driving force is not so transmitted (refer, for example, to JP-A-2005-232918).

In an open/close member driving apparatus described in JP-A-2005-232918, a speed reduction mechanism is disposed on one side of a flat plate-like base member, while a clutch mechanism is disposed on another side, whereby the speed reduction mechanism and the clutch mechanism are mounted on the base member in such a state that they are aligned or superposed on each other in an axial direction.

In the related open/close member driving apparatus that has been described above, since the speed reduction mechanism and the clutch mechanism are disposed in such a state that they are superposed on each other in the axial direction, its axial size, that is, its thickness becomes relatively large. This makes it difficult for the driving apparatus to be accommodated in a limited space or, in particular, a narrow space defined between an inner panel and an outer panel of a vehicle. To make this happen, a countermeasure needs to be taken such as swelling the inner panel to project into the inside of the vehicle. This poses a limitation on vehicle body design.

SUMMARY OF THE INVENTION

An object of the present invention is to provide an open/close member driving apparatus which can decrease the axial size thereof so as to enable the realization of reduction in thickness in the configuration in which the clutch mechanism and the speed reduction mechanism are aligned or superposed on each other in the axial direction.

According to a first aspect of the invention, there is provided an open/close member driving apparatus including: a motor; a transmission member for transmitting a driving force of the motor to an open/close member; a base member including: a swollen portion having a circular shape projected from one side of the base member to another side thereof; and a recess portion having a dish-shape on a rear side of the swollen portion; a speed reduction mechanism facing the swollen portion; a shaft; an output drum pivotally supported on a base member via the shaft and to which the transmission member is connected; and a clutch mechanism to which a driving force from the motor is inputted via the speed reduction mechanism and switches between an engaged state in which the driving force is transmitted to the output drum and a disengaged state in which the driving force is not so transmitted, the clutch mechanism and the speed reduction mechanism being superposed via the base member, a part of the clutch mechanism being accommodated in the recess portion.

According to a second aspect of the invention, the open/close member driving apparatus further includes a gear housing for housing the speed reduction mechanism, wherein the gear housing accommodates the swollen portion.

According to a third aspect of the invention, the speed reduction mechanism includes a speed reduction gear, and the gear housing accommodates the speed reduction gear.

According to a fourth aspect of the invention, the gear housing accommodates the swollen portion on a side facing the base member.

According to a fifth aspect of the invention, the open/close member driving apparatus further includes a fastening member, wherein the part of the clutch mechanism is fixed to the recess portion from the another side of the base member by a fastening member.

According to a sixth aspect of the invention, the speed reduction mechanism includes an annular recess on a side facing a head of the fastening member.

According to a seventh aspect of the invention, the clutch mechanism includes a field core into which an electromagnetic coil is incorporated and which is fixed to the recess portion.

According to an eighth aspect of the invention, the base member includes a through hole in a step portion formed on a circumferential side of the swollen portion so that a lead wire led out from the electromagnetic coil is passed therethrough.

According to the aspects of the invention, the circular swollen portion is formed on the base member in such a manner as to project from one side to another side thereof, the swollen portion is disposed in such a manner as to face the speed reduction mechanism, and part of the clutch mechanism is accommodated within the dish-shaped recess formed on the rear side of the swollen portion. This configuration allows the clutch mechanism to be disposed in such a state that the clutch mechanism is close to the speed reduction mechanism. Accordingly, the axial size of the driving apparatus can be decreased, thereby making it possible to realize a reduction in thickness thereof.

Further, according to the aspects of the invention, the swollen portion is accommodated on the side of the gear housing of the speed reduction mechanism for accommodating the speed reduction gear which side faces the base member. This configuration allows the projecting amount of the swollen portion to be absorbed. Accordingly, the total axial size of the clutch mechanism and the speed reduction mechanism can be decreased further.

Still further, according to the aspects of the invention, the annular recess is provided on the side of the speed reduction gear of the speed reduction mechanism which side faces the head of the fastening member which fixes part of the clutch mechanism in the recess formed on the rear side of the swollen portion. Thus, even in the event that the swollen portion is disposed close to the side of the speed reduction gear, the interference of the head of the fastening member with the side of the speed reduction gear can be prevented.

Still further, according to the aspects of the invention, the lead wire that is lead out from the electromagnetic coil can be led out to the outside of the apparatus through the through hole provided in the step portion which constitutes the circumferential side of the swollen portion. This configuration allows the thickness of the lead wire to be absorbed by the step portion and ensures that the lead wire, the output drum, the clutch mechanism and the speed reduction gear are not brought into contact with each other to thereby prevent the disconnection of the lead wire or the like.

DETAILED DESCRIPTION OF THE PREFERRED EMBODIMENTS

Figure 1:
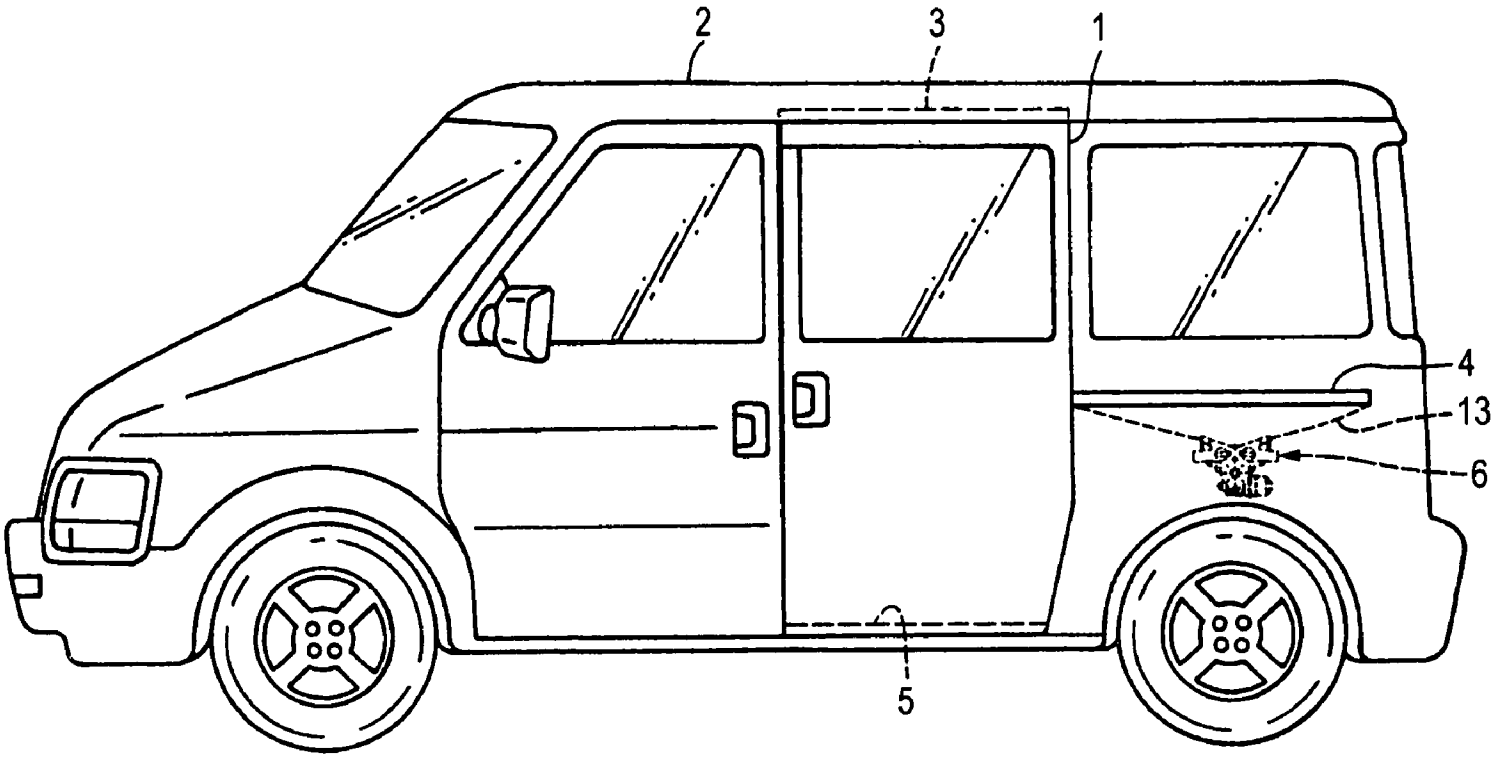
FIG. 1 is a side view of a vehicle to which an embodiment of the invention is applied.
Figure 2:
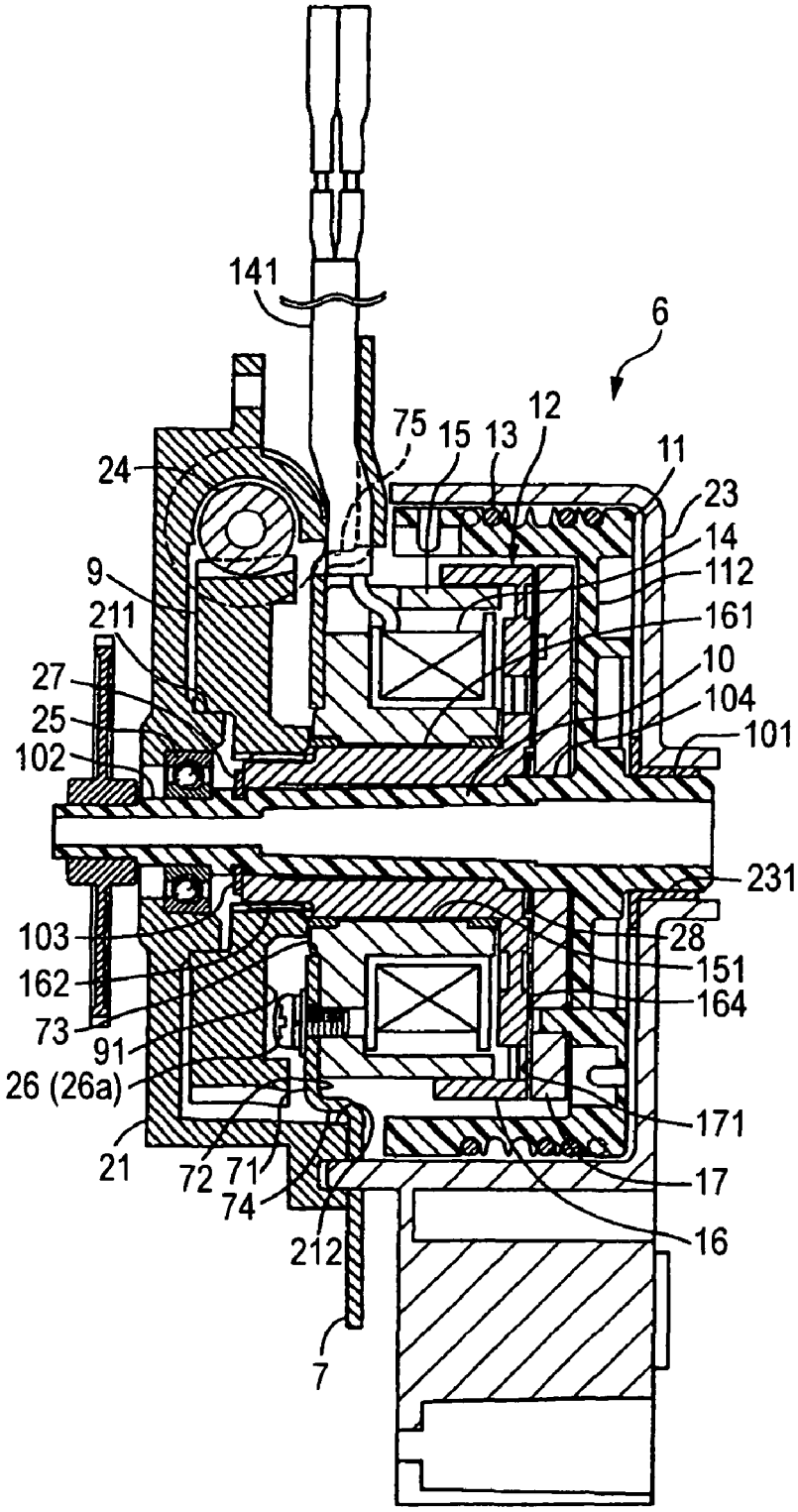
FIG. 2 is a vertical sectional view of a driving apparatus.
Figure 3:
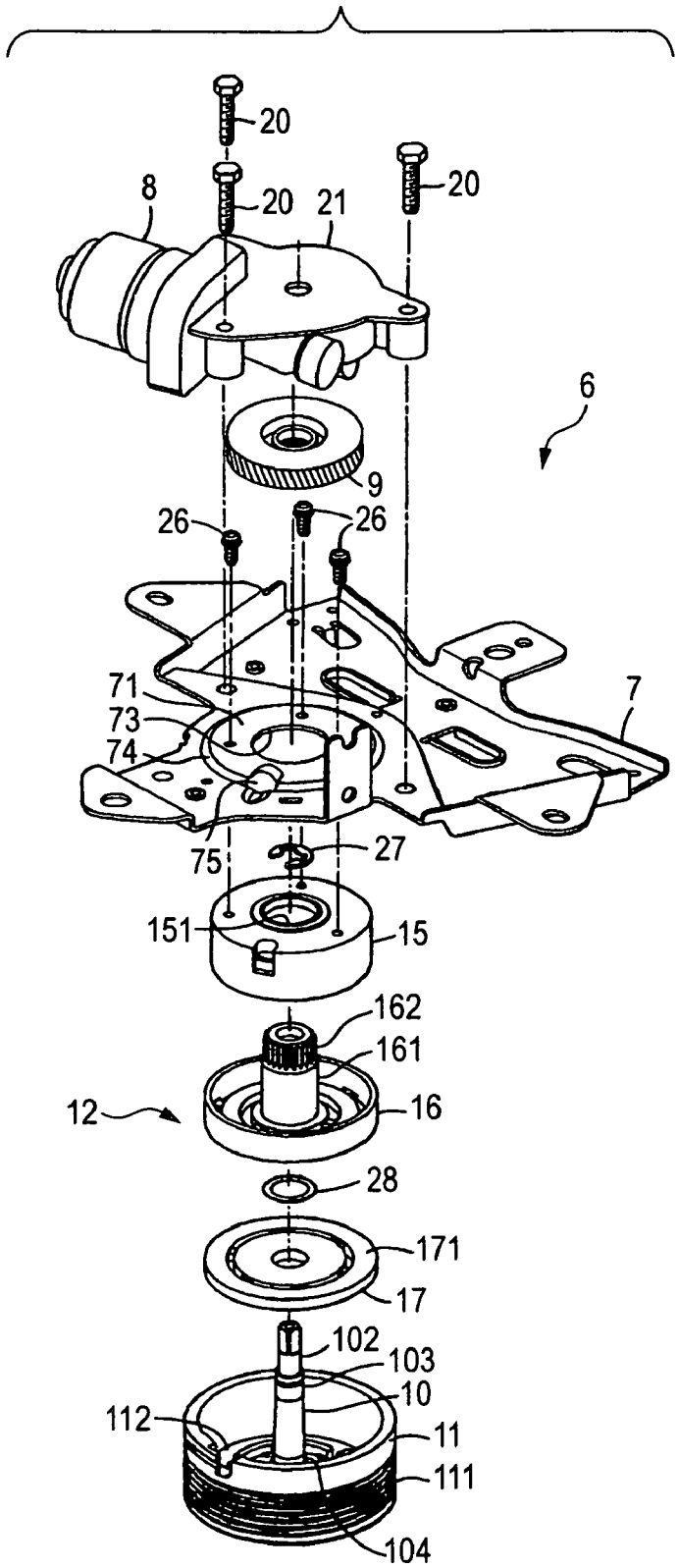
FIG. 3 is an exploded perspective view of the driving apparatus.

Hereinafter, an embodiment of the invention will be described based on the drawings. FIG. 1 is a side view of a vehicle to which an embodiment of the invention is applied. FIG. 2 is a vertical sectional view of a driving apparatus. FIG. 3 is an exploded perspective view of the driving apparatus. Note that in the following description, the left in FIG. 1 is regarded as the "front" and the right in FIG. 1 is as the "rear."

As is shown in FIG. 1, a sliding door (1), which constitutes an open/close member of a minivan or wagon type vehicle, is supported in such a manner as to slide forwards and backwards to cover and uncover a corresponding entrance/exit opening in a vehicle body (2) by upper, center, and lower guide rails (3), (4), (5) which are provided on a side of the vehicle body (2). By manual operation or by a driving apparatus (6) assembled to the rear of the vehicle body (2), the sliding door can be moved slightly outboards of an outer surface of the vehicle body (2) from its totally closed position where it covers the entrance/exit opening in the vehicle body (2) to then be moved rearwards along the side of the vehicle body (2) to a fully opened position and be moved forwards to the original, totally closed position.

As shown in FIGS. 2, 3, the driving apparatus (6) includes a metallic base plate (7) which constitutes a base member which is fixed to the vehicle body (2), a motor (8) which can rotate forwards and backwards, a worm wheel (9) which constitutes a speed reduction mechanism which can rotate while reducing a rotational speed of the motor (8), a synthetic resin output drum (11) which is pivotally supported in such a manner as to rotate freely by a shaft (10) which is oriented laterally in FIG. 2 and round which a cable (13) which constitutes a transmission member for transmitting a driving force of the motor (8) to the sliding door (1) is wound for connection thereto, and a clutch mechanism (12) which can be engaged and disengaged to connect and disconnect a driving force transmission path between the worm wheel (9) and the output drum (11).

A gear housing (21), which accommodates therein the worm wheel (9), is fixed to one side (a left side in FIG. 2, and an upper side in FIG. 3) of the base plate (7) with screws 20. A housing (23) which accommodates therein the output drum (11) and the clutch mechanism (12) is fixed to another side (a right side in FIG. 2, and a lower side in FIG. 3) of the base plate (7) by screws (not shown). Note that the motor (8) is mounted on the one side of the base plate (7) via the gear housing (21).

The base plate (7) is formed through, for example, press work and part of the base plate (7) is pressed from the side on which the clutch mechanism (12) is mounted to the side on which the worm wheel (9) is disposed into a circular shape, so as to form a circular swollen portion (71) which projects to the one side of the base plate (7). In addition, a recess (72) having a dish-shape is formed on an opposite rear side (a right side in FIG. 2, and a lower side in FIG. 3) of the swollen portion (71).

As is shown in FIG. 2, the swollen portion (71) is accommodated into the gear housing (21) from an opening (212) of the gear housing (21) which faces the one side of the base plate (7) so as to face closely a side of the worm wheel (9). Accordingly, a space between the worm wheel (9) and the base plate (7) can be decreased.

Part of a field core (15), which will be described later on, of the clutch mechanism (12) is accommodated within the recess (72) lying on the opposite side of the swollen portion (71). A through hole (73) is formed in the center of the recess (72), and a through hole (75) is formed in a step portion (74) which constitutes a circumferential side of the swollen portion (71) so that a lead wire (141) which is led out from an electromagnetic coil (14) (which will be described later on) is passed therethrough.

The cable (13), which is wound round an outer circumference of the output drum (11), is hooked round, respectively, guide members (not shown) provided at front and rear end portions of the guide rail (4). The cable (13) is laid to extend along the guide rail (4) and is connected to the sliding door (1) at end portions thereof.

As is shown in FIG. 2, the worm wheel (9) is fitted on a cylindrical bearing cylinder portion (211) provided in an interior of the gear housing (21), so as to be supported rotatably inside the gear housing (21). The worm wheel (9) meshes with a worm (24) which is securely fixed to an output shaft of the motor (8) and rotates while reducing the rotational speed of the motor (8). An annular recess (91) is provided on a side of the worm wheel (9) which faces the swollen portion (71).

The output drum (11) is formed substantially into a bottomed cylindrical shape and has a spiral groove formed to extend round the outer circumferential surface thereof so that the cable (13) is wound thereround. In addition, a shaft (10) is formed integrally in a central portion of an end lid portion (112).

One end portion (101) of the shaft (10) which projects from an external side (a right side in FIG. 2, and a lower side in FIG. 3) of the end lip portion (112) of the output drum (11) towards the housing (23) side is pivotally fitted in a bearing hole (231) provided in the housing (23) in such a manner as to rotate freely. Another end portion (102) which similarly projects from an internal side (a left side in FIG. 2, and an upper side in FIG. 3) of the end lid portion (112) of the output drum (11) towards the gear housing (21) side is rotatably supported inside the bearing cylinder portion (211) via a bearing (25).

A diametrically expanded portion (104) is formed at a root portion of the shaft (10) which projects from the internal side of the end lid portion (112) of the output drum (11). A fitting groove (103) is provided in a position on an outer circumference of the shaft (10) which lies closer to the another end portion (102) so that an E-washer (27) is fitted therein in an axial direction.

After an armature (17) and a bearing cylinder portion (161) of a rotor (16) are rotatably fitted on the shaft (10), the E-washer (27) is fitted in the fitting groove (103) provided on the outer circumference of the shaft (10). Accordingly, an axial looseness of the rotor (16) relative to the shaft (10) is restricted. The armature (17) and the rotor (16) will be described later on.

The clutch mechanism (12) includes the substantially cylindrical field core (15), the rotor (16) and the armature (17). The field core (15) having the electromagnetic coil (14) incorporated therein is made of a magnetic material and is fixed to another side of the base plate (7) by screws (26) which constitute fastening members. The rotor (16) which is rotatably fitted on the shaft (10) passing through a through hole (151) provided in a central portion of the field core (15). The armature (17) is fitted on the diametrically expanded portion (104) of the shaft (10) slightly movably in the axial direction in such a manner as that a friction surface (171) thereof faces a friction surface (164) of the rotor (16).

The rotor (16), the armature (17) and the field core (15) are accommodated on an inside diameter side of the output drum (11). In addition, heads (26*a*) of the screws (26) which fix the field core (15) to the base plate (7) from the one side of the base plate (7) project from the one side of the base plate (7). In this embodiment, however, the recess (91) is provided on the side of the worm wheel (9). Thus, even in the event that the side of the worm wheel (9) and the swollen portion (71) are made close to each other face to face, there occurs no case where the heads (26*a*) of the screws (26) interfere with the worm wheel (9).

The rotor (16) is made of a magnetic material and has the bearing cylinder portion (161) which projects (leftwards in FIG. 2) from an opposite side of the friction surface (164) and is fitted rotatably on the shaft (10). This bearing cylinder portion (161) passes through the through hole (151) of the field core (15) and the through hole (73) of the base plate (7) together with the shaft (10). A knurled (162) portion is formed at an end portion of the bearing cylinder portion (161) so as to be connected to the worm wheel (9).

The armature (17) is fitted on the diametrically expanded portion (104) of the shaft (10) in such a manner as to move slightly in the axial direction and is loosely fitted in the inside diameter side of the output drum (11) in such a manner as to rotate together with the output drum (11).

A wave washer (28) is provided between the rotor (16) and the armature (17). This wave washer (28) is fitted on the diametrically expanded portion (104) of the shaft (10) and biases the armature (17) in such a manner that the friction surface (171) of the armature (17) is separated away from the friction surface (164) of the rotor (16). Accordingly, an axial looseness of both the rotor (16) and the armature (17) therebetween is prevented. In addition, the armature (17) is brought into abutment with the internal side of the end lid portion (112) of the output drum (11), and the axial traveling amount thereof is restricted.

When the electromagnetic coil (14) is energized, that is, in such a state that the clutch mechanism (12) is engaged, the armature (17) is magnetically attracted to the rotor (16), so as to transmit the rotation of the motor (8) to the output drum (11) via the worm (24), the worm wheel (9), the rotor (16) and the armature (17). When the driving force of the motor (8) is transmitted to the output drum (11), the cable (13) is taken up round the output drum (11) and the sliding door (1) can be moved in a closing direction or opening direction. In addition, when the electromagnetic coil (14) is not energized, that is, in such a state that the clutch mechanism (12) is disengaged, since the connection between the rotor (16) and the armature (17) is disrupted, the sliding door (1) can manually be closed or opened without reversing the worm wheel (9) and the motor (8).

In the embodiment that is configured as has been heretofore, the circular swollen portion (71) is formed on the base plate (7) which projects from the one side to the another side thereof, the swollen portion (71) so formed is disposed in such a manner as to face the worm wheel (9), and the side of the field core (15) of the clutch mechanism (12) which faces the base plate (7) is accommodated within the dish-shaped recess (72) formed on the rear side of the swollen portion (71). Accordingly, the clutch mechanism (12) and the worm wheel (9) can be disposed close to each other via the base plate (7) held therebetween. As a result, even with the configuration in which the clutch mechanism (12) and the worm wheel (9) are aligned or superposed on each other in the axial direction, the axial size can be decreased so as to realize a reduction in thickness of the whole driving apparatus.

The swollen portion (71) is accommodated on the side of the gear housing (21) for accommodating therein the worm wheel (9) which faces the base plate (7). Accordingly, the projecting amount of the swollen portion (71) can be absorbed, and the total axial size of the clutch mechanism (12) and the worm wheel (9) can be decreased.

In addition, the side of the field core (15) of the clutch mechanism (12) which faces the base plate (7) is fixed in the recess (72) formed on the rear side of the swollen portion (71) with the screws (26), and the annular recess (91) is provided on the side of the worm wheel (9) which faces the heads (26*a*) of the screws (26). Accordingly, even in the event that the swollen portion (71) and the side of the worm wheel (9) are made close to each other, there occurs no case where the heads (26*a*) of the screws (26) interfere with the side of the worm wheel (9).

Furthermore, the lead wire (141) which is led out from the electromagnetic coil (14) is led out, in turn, to the outside of the driving apparatus through the through hole (75) provided in the step portion (74) which constitutes the circumferential side of the swollen portion (71). Accordingly, the thickness of the lead wire (141) can be absorbed by the step portion of the swollen portion (71), and the contact of the lead wire (141) with the output drum (11), the clutch mechanism (12) and the worm wheel (9) can be prevented, thereby making it possible to ensure the prevention of disconnection of the lead wire (141).

Thus, while the embodiment of the invention has been described heretofore, various modifications and alterations can be given to the embodiment without departing from the spirit and scope thereof as below.

(i) The swollen portion (71) is formed into a polygonal shape as viewed from the front thereof.

(ii) The shaft (10) is formed as a separate member from the output shaft (11).

(iii) The open/close member is used as, in place of the sliding door (1), a rear door, a sunroof or a tightly open/close apparatus.

What is claimed is:

1. An open/close member driving apparatus comprising:

a motor;

a transmission member configured to transmit a driving force of the motor to an open/close member;

a metallic base plate fixed to a vehicle body, wherein the base plate comprises:

a swollen portion having a circular shape projected from the base plate; and a recess portion having a dish-shape and formed in the swollen portion;

a speed reduction mechanism facing a surface of the swollen portion;

a shaft;

an output drum pivotally supported on the base plate via the shaft and to which the transmission member is connected;

a clutch mechanism configured to switch between an engaged state such that the driving force from the motor is transmitted via the speed reduction mechanism to the output drum and a disengaged state such that the driving force is not transmitted via the speed reduction mechanism to the output drum, wherein the clutch mechanism and the speed reduction mechanism are superposed via the base plate such that a field core of the clutch mechanism is accommodated in the recess portion; and a fastening member, wherein the field core of the clutch mechanism accommodated in the recess portion is fixed to the recess portion having the dish-shape from a side of the swollen portion by the fastening member, and wherein the speed reduction mechanism comprises an annular recess which faces a head of the fastening member.

2. The open/close member driving apparatus according to claim 1, further comprising a gear housing housing the speed reduction mechanism, wherein the gear housing accommodates the swollen portion.

3. The open/close member driving apparatus according to claim 2, wherein the speed reduction mechanism comprises a speed reduction gear, and wherein the gear housing accommodates the speed reduction gear.

4. The open/close member driving apparatus according to claim 2, wherein the gear housing accommodates the swollen portion on a side facing the base plate.

5. The open/close member driving apparatus according to claim 1, wherein an electromagnetic coil is incorporated into the field core.

6. The open/close member driving apparatus according to claim 5, wherein the base plate comprises a through hole in a step portion formed on a circumferential surface of the swollen portion such that a lead wire led out from the electromagnetic coil is passed therethrough.

7. The open/close member driving apparatus according to claim 1, wherein the clutch mechanism comprises a rotor, an armature, and the field core, and wherein the rotor, the armature and the field core are accommodated in an inside diameter side of the output drum.

8. The open/close member driving apparatus according to claim 1, wherein the metallic base plate is directly fixed to the vehicle body.

* * * * *